US008803777B2

(12) United States Patent
Do et al.

(10) Patent No.: US 8,803,777 B2
(45) Date of Patent: Aug. 12, 2014

(54) DISPLAY APPARATUS AND METHOD OF DRIVING THE SAME

(71) Applicant: Samsung Display Co., Ltd., Yongin (KR)

(72) Inventors: Hee-Wook Do, Cheonan-si (KR); Seung-Beom Park, Seoul (KR); Hoon Kim, Ansan-si (KR); Hye-Ran You, Yongin-si (KR); Jian Gang Lu, Suwon-si (KR); Hee-Seop Kim, Hwaseong-si (KR); Young-Chol Yang, Seongnam-si (KR); Seoung-Hoon Lee, Yongin-si (KR)

(73) Assignee: Samsung Display Co., Ltd., Yongin (KR)

( * ) Notice: Subject to any disclaimer, the term of this patent is extended or adjusted under 35 U.S.C. 154(b) by 0 days.

(21) Appl. No.: 13/853,481

(22) Filed: Mar. 29, 2013

(65) Prior Publication Data

US 2013/0215003 A1 Aug. 22, 2013

Related U.S. Application Data

(63) Continuation of application No. 13/541,518, filed on Jul. 3, 2012, now abandoned, which is a continuation of application No. 12/132,237, filed on Jun. 3, 2008, now Pat. No. 8,237,646.

(30) Foreign Application Priority Data

Jun. 5, 2007 (KR) ..... 10-2007-0055109

(51) Int. Cl.
*G09G 3/36* (2006.01)

(52) U.S. Cl.
USPC ..... 345/90; 345/55; 345/204; 345/92; 345/93; 345/87; 349/33; 349/41; 349/48; 349/144

(58) Field of Classification Search
USPC ..... 345/55, 204, 90, 93, 92, 87; 349/33, 41, 349/48, 144
See application file for complete search history.

(56) References Cited

U.S. PATENT DOCUMENTS

| | | | |
|---|---|---|---|
| 7,773,169 | B2 | 8/2010 | Song |
| 8,077,167 | B2 | 12/2011 | Su et al. |
| 2002/0033787 | A1 | 3/2002 | Park et al. |
| 2004/0070713 | A1 | 4/2004 | Song |
| 2004/0178409 | A1 | 9/2004 | Hong et al. |

(Continued)

OTHER PUBLICATIONS

Non-Final Office Action issued for related U.S. Appl. No. 12/132,237 dated Sep. 27, 2011.

(Continued)

*Primary Examiner* — Gregory J Tryder
(74) *Attorney, Agent, or Firm* — H.C. Park & Associates, PLC

(57) ABSTRACT

In a display apparatus having a plurality of pixel parts, each pixel part receives a data signal in response to a present gate signal and charges first and second pixel voltages having the same voltage level. A plurality of voltage controllers includes a level-down part to lower a voltage level of the second pixel voltage using a previous pixel voltage charged in a previous frame in response to a next gate signal and a level-up part to receive the lowered second pixel voltage in response to the next gate signal to boost up a voltage level of the first pixel voltage.

9 Claims, 11 Drawing Sheets

(56) References Cited

U.S. PATENT DOCUMENTS

| | | | | |
|---|---|---|---|---|
| 2005/0030460 | A1 | 2/2005 | Kim et al. | |
| 2005/0036091 | A1* | 2/2005 | Song | 349/129 |
| 2005/0122441 | A1 | 6/2005 | Shimoshikiryoh | |
| 2006/0023137 | A1* | 2/2006 | Kamada et al. | 349/44 |
| 2006/0103800 | A1 | 5/2006 | Li et al. | |
| 2006/0145981 | A1 | 7/2006 | Lee et al. | |
| 2006/0215066 | A1* | 9/2006 | Ueda et al. | 349/38 |
| 2006/0262237 | A1 | 11/2006 | Chen et al. | |
| 2006/0284811 | A1* | 12/2006 | Huang | 345/92 |
| 2007/0046601 | A1 | 3/2007 | Shin et al. | |
| 2007/0058123 | A1* | 3/2007 | Um et al. | 349/144 |
| 2007/0064164 | A1* | 3/2007 | Tasaka et al. | 349/38 |
| 2007/0109238 | A1 | 5/2007 | Lee et al. | |
| 2007/0146600 | A1 | 6/2007 | Song | |
| 2008/0062107 | A1 | 3/2008 | Su et al. | |
| 2008/0143900 | A1 | 6/2008 | Tsao et al. | |
| 2008/0143912 | A1 | 6/2008 | Kim | |

OTHER PUBLICATIONS

Notice of Allowance issued for related U.S. Appl. No. 12/132,237 dated Apr. 3, 2012.

Non-Final Office Action issued for related U.S. Appl. No. 13/541,518 dated Sep. 19, 2012.

* cited by examiner

DISPLAY APPARATUS AND METHOD OF DRIVING THE SAME

CROSS-REFERENCE TO RELATED APPLICATIONS

This application is a continuation of U.S. patent application Ser. No. 13/541,518, filed on Jul. 3, 2012, which is a continuation of U.S. patent application Ser. No. 12/132,237, filed on Jun. 3, 2008, and has issued as U.S. Pat. No. 8,237,646, and claims priority from and the benefit of Korean Patent Application No. 10-2007-0055109, filed on Jun. 5, 2007, all of which are hereby incorporated by reference for all purposes as if fully set forth herein.

BACKGROUND OF THE INVENTION

1. Field of the Invention

The present invention relates to a display apparatus and a method of driving the display apparatus. More particularly, the present invention relates to a display apparatus that may have improved visibility and transmittance and a method of driving the display apparatus.

2. Discussion of the Background

In general, a liquid crystal display (LCD) includes a display panel having a lower substrate, an upper substrate facing the lower substrate, and a liquid crystal layer interposed between the lower substrate and the upper substrate to display an image. The display panel includes a plurality of gate lines, a plurality of data lines, and a plurality of pixels connected to the gate lines and the data lines.

As compared to other types of display apparatuses, LCDs have a relatively narrow viewing angle. In order to improve the viewing angle, various driving methods for the LCD, such as a patterned vertical alignment (PVA) mode, a multi-domain vertical alignment (MVA) mode, and a super-patterned vertical alignment (S-PVA) mode, have been suggested.

The S-PVA mode LCD includes pixels each having two sub pixels, and each sub pixel includes a main pixel electrode and a sub pixel electrode to which different sub voltages are applied to form domains having different grays from each other in the pixel. Since human eyes watching the S-PVA mode LCD recognize an intermediate value of the two sub voltages, the S-PVA mode LCD prevents deterioration of side visibility due to distortion of a gamma curve under an intermediate gray scale, thereby improving the side visibility of the S-PVA mode LCD.

The S-PVA mode LCD may be a coupling capacitor type (CC-type) or a two-transistor type (TT-type) according to the driving method thereof. The CC-type S-PVA mode LCD further includes a coupling capacitor between the main pixel electrode and the sub pixel electrode. The voltage level of a data voltage is dropped and then applied to the sub pixel electrode as a sub pixel voltage, which has a lower voltage level than that of the main pixel voltage. In the TT-type S-PVA mode LCD, the main pixel voltage and the sub pixel voltage having different voltage levels are applied to the main pixel electrode and the sub pixel electrode, respectively, using two transistors.

Recently, a charge-shared type (CS-type) S-PVA mode LCD has been suggested to prevent brightness deterioration and image blurring. However, in the CS-type S-PVA mode LCD, the transmittance may deteriorate when the visibility is improved, and the visibility may be degraded when the transmittance is improved.

SUMMARY OF THE INVENTION

The present invention provides a display apparatus that may have improved visibility and transmittance.

The present invention also provides a method of driving the display apparatus.

Additional features of the invention will be set forth in the description which follows, and in part will be apparent from the description, or may be learned by practice of the invention.

The present invention discloses a display apparatus including a plurality of gate lines to sequentially receive a gate signal, a plurality of data lines that are insulated from the gate lines to receive a data signal, a plurality of pixel parts, and a plurality of voltage controllers. Each pixel part includes a first pixel to receive the data signal to charge a first pixel voltage in response to a present gate signal and a second pixel to receive the data signal to charge a second pixel voltage in response to the present gate signal. Each voltage controller includes a level-down part and a level-up part, and the voltage controllers are connected with the pixel parts in one-to-one correspondence. The level-down part lowers a voltage level of the second pixel voltage using a previous pixel voltage previously charged in a previous frame in response to a next gate signal, and the level-up part receives the lowered second pixel voltage to boost up a voltage level of the first pixel voltage in response to the next gate signal.

The present invention also discloses a display apparatus including a first base substrate, a plurality of gate lines, a plurality of data lines, a plurality of first pixels, a plurality of second pixels, a plurality of voltage controllers, a second base substrate, and a common electrode. The gate lines are arranged on the first base substrate and sequentially receive a gate signal. The data lines are arranged on the first base substrate and receive a data signal. The data lines are insulated from and cross the gate lines to define a plurality of pixel areas on the first base substrate. The first pixels are arranged in the pixel areas in one-to-one correspondence, and each first pixel includes a first switching device that outputs the data signal in response to a present gate signal and a first pixel electrode connected to an output terminal of the first switching device. The second pixels are arranged in the pixel areas in one-to-one correspondence, and each second pixel includes a second switching device that outputs the data signal in response to the present gate signal and a second pixel electrode connected to an output terminal of the second switching device. The voltage controllers are arranged in the pixel areas in one-to-one correspondence, and each voltage controller includes a down-capacitor in which a previous pixel voltage of a previous frame is charged, a third switching device connecting the down-capacitor to the second pixel electrode in response to a next gate signal, an up-capacitor connected to the first pixel electrode, and a fourth switching device connecting the up-capacitor to the down-capacitor in response to the next gate signal. The second base substrate is combined with the first base substrate while facing the first substrate, and a common electrode is arranged on the second base substrate and faces the first and second pixel electrodes. The common electrode receives a common voltage.

The present invention also discloses a method of driving a display apparatus. A first pixel voltage and a second pixel voltage are charged in a first pixel and a second pixel of a present pixel part, respectively, in response to a present gate signal. Then, a voltage level of the second pixel voltage charged in the second pixel is lowered by using a previous pixel voltage charged during a previous frame in response to a next gate signal. A voltage level of the first pixel voltage is boosted up by the lowered second pixel voltage that is applied in response to the next gate signal.

The present invention also discloses a display apparatus including a first gate line to receive a present gate signal, a second gate line to receive a next gate signal, a data line insulated from and crossing the first gate line the second gate line, and a pixel part. The second gate line is spaced apart from the first gate line. The data line receives a data signal. The pixel part includes a first pixel part, a second pixel part, a level-down part, and a level-up part. The first pixel receives the data signal to charge a first pixel voltage in response to the present gate signal, and the second pixel receives the data signal to charge a second pixel voltage in response to the present gate signal. The level-down part lowers a voltage level of the second pixel voltage in response to the next gate signal, and the level-up part receives the lowered second pixel voltage to boost up a voltage level of the first pixel voltage in response to the next gate signal.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
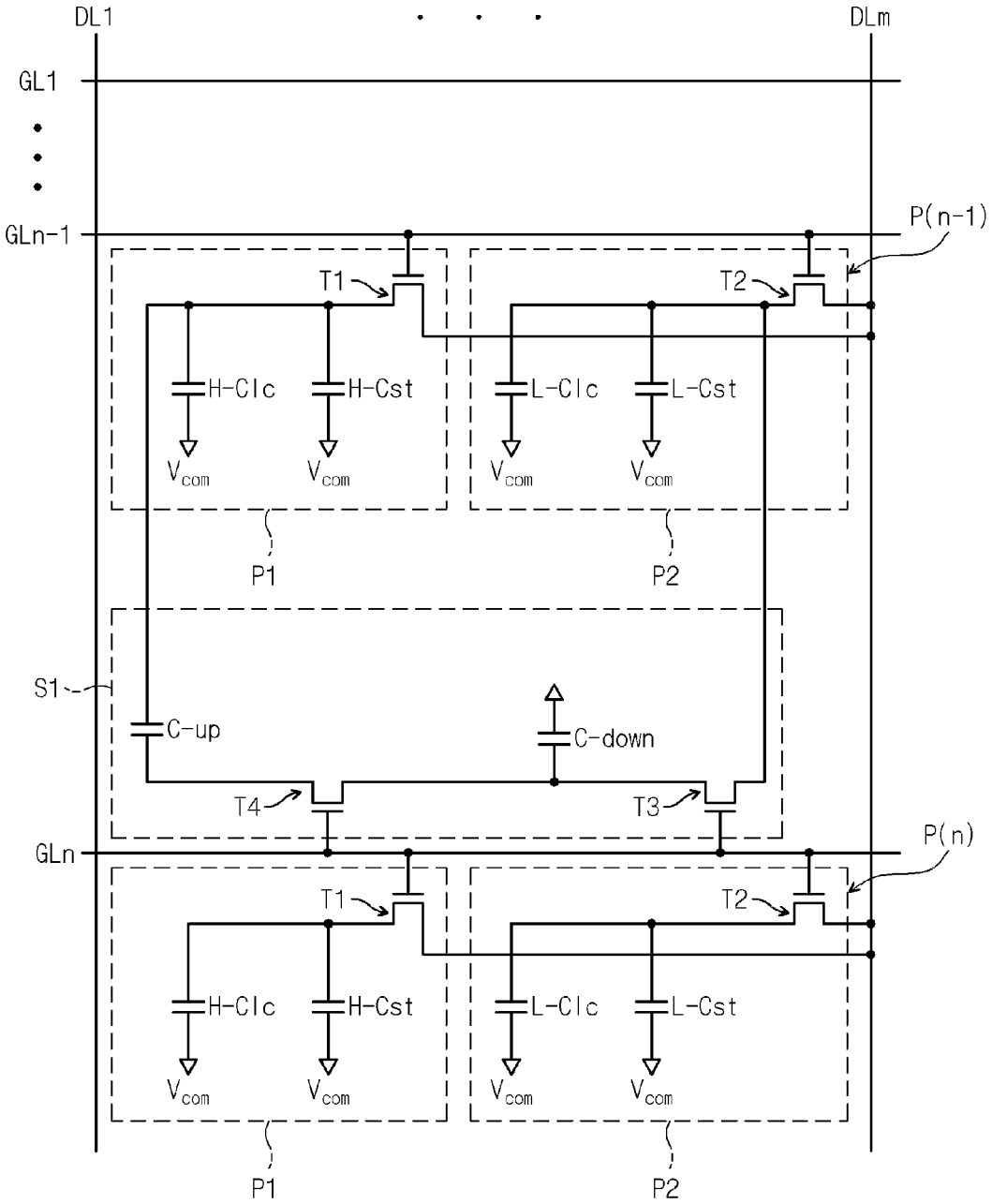
FIG. 1 is an equivalent circuit diagram showing a pixel part and a voltage controller in a display apparatus according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the size and relative sizes of layers and regions may be exaggerated for clarity.

It will be understood that when an element or layer is referred to as being "on", "connected to" or "coupled to" another element or layer, it can be directly on, connected or coupled to the other element or layer or intervening elements or layers may be present. In contrast, when an element is referred to as being "directly on," "directly connected to" or "directly coupled to" another element or layer, there are no intervening elements or layers present. Like numbers refer to like elements throughout. As used herein, the term "and/or" includes any and all combinations of one or more of the associated listed items.

It will be understood that, although the terms first, second, etc. may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section discussed below could be termed a second element, component, region, layer or section without departing from the teachings of the present invention.

Spatially relative terms, such as "beneath", "below", "lower", "above", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, the exemplary term "below" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms, "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Hereinafter, exemplary embodiment of the present invention will be explained in detail with reference to the accompanying drawings.

Figure 2A:
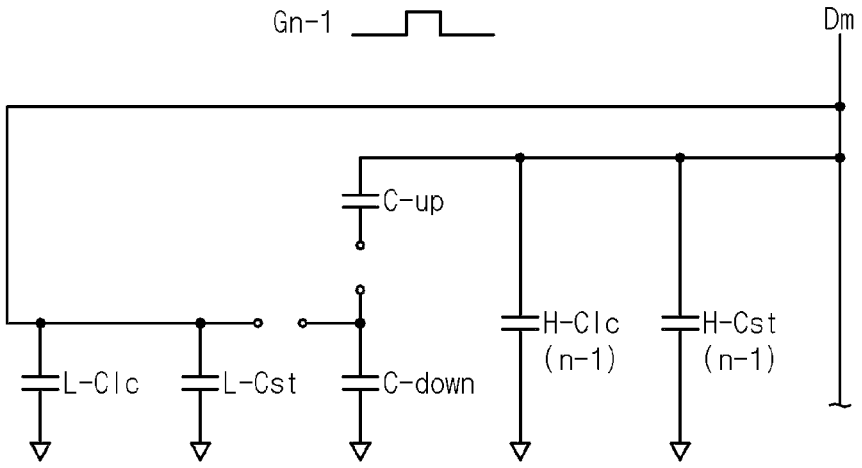
FIG. 2A is an equivalent circuit diagram showing an $(n-1)^{th}$ pixel when an $(n-1)^{th}$ gate signal is applied to an $(n-1)^{th}$ gate line of FIG. 1.
Figure 2B:
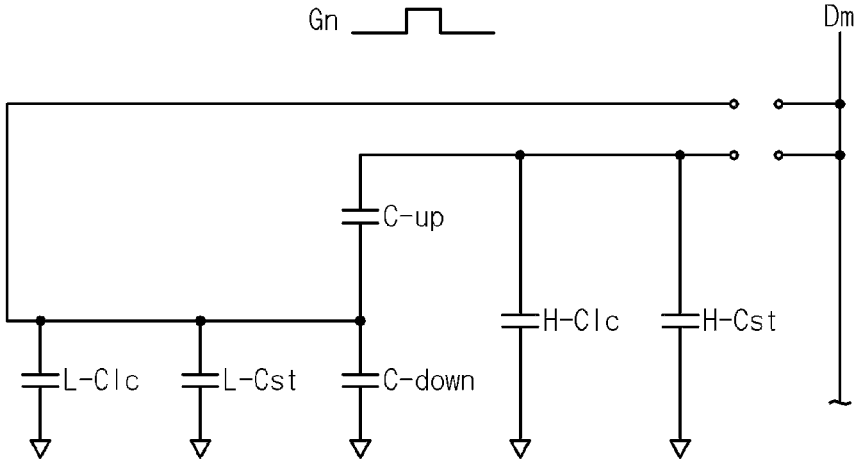
FIG. 2B is an equivalent circuit diagram showing an $(n-1)^{th}$ pixel when an $n^{th}$ gate signal is applied to an $n^{th}$ gate line of FIG. 1.

FIG. 1 is an equivalent circuit diagram showing a pixel part and a voltage controller in a display apparatus according to an exemplary embodiment of the present invention, FIG. 2A is an equivalent circuit diagram showing an $(n-1)^{th}$ pixel when an $(n-1)^{th}$ gate signal is applied to an $(n-1)^{th}$ gate line of FIG. 1, and FIG. 2B is an equivalent circuit diagram showing an $(n-1)^{th}$ pixel when an $n^{th}$ gate signal is applied to an $n^{th}$ gate line of FIG. 1.

Referring to FIG. 1, a display apparatus includes first to $n^{th}$ gate lines GL1~GLn and first to $m^{th}$ data lines DL1~DLm. A plurality of pixel areas are defined by the first to $n^{th}$ gate lines GL1~GLn and the first to $m^{th}$ data lines DL1~DLm, and a plurality of pixel parts are arranged in the pixel areas in one-to-one correspondence relationship.

In FIG. 1, equivalent circuit diagrams of an $(n-1)^{th}$ pixel part P(n−1) and $n^{th}$ pixel part P(n) connected to an $(n-1)^{th}$ gate line GLn-1 and an $m^{th}$ data line DLm have been shown. In the present exemplary embodiment, the pixel parts have a same circuit configuration, and thus only the $(n-1)^{th}$ pixel part P(n−1) will be described in detail in order to avoid redundancy.

The $(n-1)^{th}$ pixel part P(n−1) includes a first pixel P1 and a second pixel P2. The first pixel P1 includes a first thin film transistor T1, a first liquid crystal capacitor H-Clc, and a first storage capacitor H-Cst, and the second pixel P2 includes a second thin film transistor T2, a second liquid crystal capacitor L-Clc, and a second storage capacitor L-Cst.

Particularly, the first thin film transistor T1 includes a first gate electrode connected to the $(n-1)^{th}$ gate line GLn-1, a first source electrode connected to the $m^{th}$ data line DLm, and a first drain electrode connected to the first liquid crystal capacitor H-Clc. The first liquid crystal capacitor H-Clc is defined by a first pixel electrode connected to the first drain electrode, a common electrode facing the first pixel electrode and receiving a common voltage Vcom, and a liquid crystal layer (not shown) interposed between the first pixel electrode and the common electrode. The first storage capacitor H-Cst is defined by the first pixel electrode, a storage electrode receiving the common voltage, and an insulating layer interposed between the first pixel electrode and the storage electrode.

The second thin film transistor T2 includes a second gate electrode connected to the $(n-1)^{th}$ gate line GLn-1, a second source electrode connected to the $m^{th}$ data line DLm, and a second drain electrode connected to the second liquid crystal capacitor L-Clc. The second liquid crystal capacitor L-Clc is defined by a second pixel electrode connected to the second drain electrode, the common electrode facing the second pixel electrode and receiving the common voltage Vcom, and the liquid crystal layer interposed between the second pixel electrode and the common electrode. The second storage capacitor L-Cst is defined by the second pixel electrode, the storage electrode receiving the common voltage Vcom, and the insulating layer interposed between the second pixel electrode and the storage electrode.

The gate signal is sequentially applied to the first to $n^{th}$ gate lines GL1~GLn during one frame. In the present exemplary embodiment, a period during which the gate signal is sequentially applied to each of the first to $n^{th}$ gate lines GL1~GLn is defined as a horizontal scanning period 1H.

The data signal is applied to the first to $m^{th}$ data lines DL1~DLm. The data signal is applied to the first to $m^{th}$ data lines DL1~DLm in synchronization with the gate signal that is sequentially applied to the first to $n^{th}$ gate lines GL1~GLn.

As shown in FIG. 1 and FIG. 2A, when the $(n-1)^{th}$ gate signal Gn-1 is applied to the $(n-1)^{th}$ gate line GLn-1, the first and second thin film transistors T1 and T2, which are arranged in the first and second pixels P1 and P2, respectively, are turned on. Thus, the data signal applied to the $m^{th}$ data line DLm is provided to the first and second pixel electrodes of the first and second liquid crystal capacitors H-Clc and L-Clc through the first and second thin film transistors T1 and T2, respectively. Since the first and second pixel electrodes of the first and second liquid crystal capacitors H-Clc and L-Clc are commonly connected to the $m^{th}$ data line DLm, the first and second pixel electrodes substantially simultaneously receive the data signal. Accordingly, a first pixel voltage and a second pixel voltage having a same voltage level are charged in the first and second liquid crystal capacitors H-Clc and L-Clc, respectively, during an $(n-1)^{th}$ horizontal scanning period.

The display apparatus further includes a voltage controller S1 that is connected to the $n^{th}$ gate line GLn and the $(n-1)^{th}$ pixel part P(n−1) to control a voltage level of the first and second pixel voltages that are respectively charged in the first and second pixels P1 and P2 of the $(n-1)^{th}$ pixel part P(n−1).

The voltage controller S1 includes a level-down part having a third thin film transistor T3 and a down-capacitor C-down and a level-up part having a fourth thin film transistor T4 and an up-capacitor C-up.

The third thin film transistor T3 includes a third gate electrode connected to the $n^{th}$ gate line GLn, a third source electrode connected to the second pixel electrode, and a third drain electrode connected to the down-capacitor C-down. The fourth thin film transistor T4 includes a fourth gate electrode connected to the $n^{th}$ gate line GLn, a fourth source electrode connected to the down-capacitor C-down, and a fourth drain electrode connected to the up-capacitor C-up.

The down-capacitor C-down is defined by the storage electrode, a first opposite electrode that is partially overlapped with the storage electrode and connected to the third drain electrode, and an insulating layer interposed between the first opposite electrode and the storage electrode. The up-capacitor C-up is defined by the first pixel electrode, a second opposite electrode that is partially overlapped with the first pixel electrode and connected to the fourth drain electrode, and the insulating layer interposed between the second opposite electrode and the first pixel electrode.

As shown in FIG. 1 and FIG. 2B, when the third and fourth thin film transistors T3 and T4 are turned on in response to the $n^{th}$ gate signal Gn applied to the $n^{th}$ gate line GLn, the second liquid crystal capacitor L-Clc is connected to the down-capacitor C-down through the third thin film transistor T3, and the down-capacitor C-down is connected to the up-capacitor C-up through the fourth thin film transistor T4.

As a result, the second liquid crystal capacitor L-Clc shares a charge with the down-capacitor C-down in response to the $n^{th}$ gate signal Gn. The down-capacitor C-down is previously charged by a previous pixel voltage in response to a data signal applied in a previous frame. Since the polarity of the data signal is inverted at every frame, the polarity of the previous pixel voltage is opposite to polarities of the first and second pixel voltages. Thus, the second pixel voltage charged in the second liquid crystal capacitor L-Clc by the third thin film transistor T3 is lowered by the previous pixel voltage.

The voltage charged in the down-capacitor C-down is boosted up during a charge-sharing operation, and the first pixel voltage of the first liquid crystal capacitor H-Clc connected to the up-capacitor C-up is also boosted up. Consequently, the voltage levels of the first pixel voltage charged in the first liquid crystal capacitor H-Clc and the second pixel voltage charged in the second liquid crystal capacitor L-Clc are controlled by the up-capacitor C-up and the down-capacitor C-down. That is, the voltage level of first pixel voltage is boosted up by the up-capacitor C-up and the voltage level of second pixel voltage is lowered by the down-capacitor C-down.

As described above, the first pixel voltage and the second pixel voltage having the same voltage level are charged in the first pixel P1 and the second pixel P2 of the $(n-1)^{th}$ pixel part P(n−1) in response to the $(n-1)^{th}$ gate signal, and then, the first pixel voltage and the second pixel voltage are controlled to have the different voltage levels from each other by the $n^{th}$ gate signal Gn. Thus, the first and second pixels P1 and P2 of the $(n-1)^{th}$ pixel part P(n−1) may display two images having different gray-scale levels from each other. Further, the user recognizes an image in which the two images are mixed with each other, so that the visibility of the display apparatus may be improved.

Figure 3A:
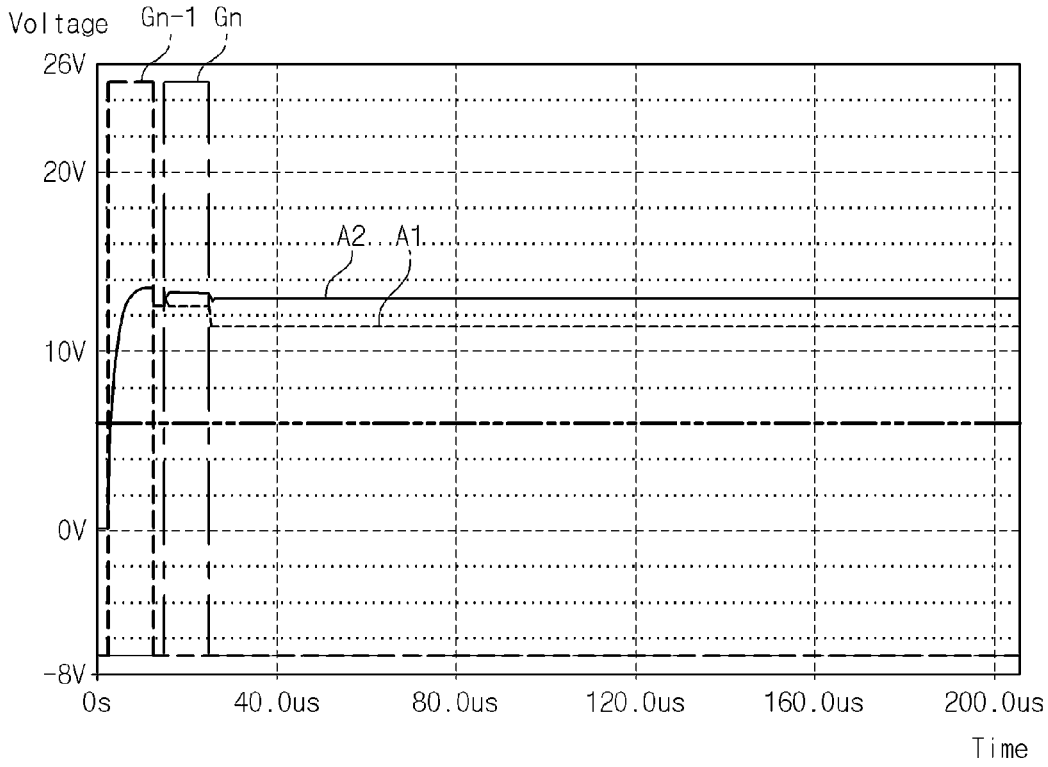
FIG. 3A is a graph showing voltage variations of first and second pixel voltages respectively charged in first and second pixels as a function of time in a conventional structure.
Figure 3B:
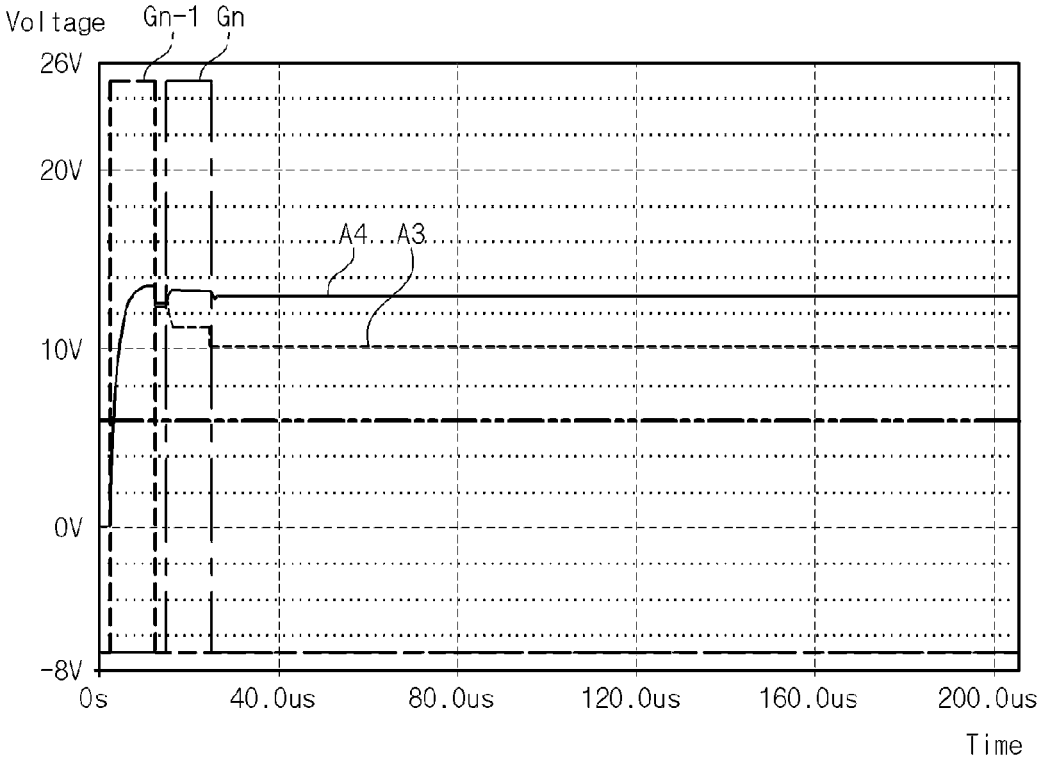
FIG. 3B is a graph showing voltage variations of first and second pixel voltages respectively charged in first and second pixels as a function of time according to an exemplary embodiment of the present invention.

FIG. 3A is a graph showing voltage variations of first and second pixel voltages respectively charged in first and second pixels as a function of a time in a conventional structure, and FIG. 3B is a graph showing voltage variations of first and second pixels respectively charged in first and second pixels as a function of a time according to an exemplary embodiment of the present invention.

In FIG. 3A, a first graph A1 represents voltage variations of a second pixel voltage according to time in a conventional CS-type S-PVA mode LCD, and a second graph A2 represents voltage variations of a first pixel voltage according to time in the conventional CS-type S-PVA mode LCD. In FIG. 3B, a third graph A3 represents voltage variations of a second pixel voltage according to time in the S-PVA mode LCD according to an exemplary embodiment of the present invention, and a fourth graph A4 represents voltage variations of a first pixel voltage according to time in the S-PVA mode LCD according to the exemplary embodiment of the present invention.

Referring to FIG. 3A, in the conventional S-PVA mode LCD, when an $(n-1)^{th}$ gate signal Gn-1 is generated at high state, first and second pixel voltages are respectively charged to about 13.5 V, and when the $(n-1)^{th}$ gate signal Gn-1 is dropped to low state, the first and second pixel voltages decrease by a kick-back voltage. Then, when an $n^{th}$ gate signal Gn is generated at high state, the first pixel voltage increases to about 13.3 V, and the second pixel voltage is dropped again to about 12.5 V. When the $n^{th}$ gate signal Gn is dropped to low state, the first and second pixel voltages are lowered again by the kick-back voltage, and then, the first and second pixel voltages are continuously maintained in the lowered state. In FIG. 3A, a voltage difference between the first pixel voltage and the second pixel voltage is about 1.5 V.

Referring to FIG. 3B, like the conventional S-PVA mode LCD, when the $(n-1)^{th}$ gate signal Gn-1 is generated at high state, the first and second pixel voltages are respectively charged to about 13.5 V, and when the $(n-1)^{th}$ gate signal is dropped to low state, the first and second pixel voltages decrease by a kick-back voltage. Then, when the $n^{th}$ gate signal Gn is generated at high state, the first pixel voltage increases to about 13.7 V that is higher than that in the conventional S-PVA mode LCD, and the second pixel voltage decreases to about 11.3 V. When the $n^{th}$ gate signal Gn is dropped to low state, the first and second pixel voltages decrease by a kick-back voltage, and then, the first and second pixel voltages are maintained in the lowered state. In FIG. 3B, a voltage difference between the first and second pixel voltages is about 2.5 V.

As a result, in the exemplary embodiment of the present invention in which the second pixel voltage is lowered using the previous pixel voltage, the voltage difference between the first and second pixel voltages is greater than that of the conventional S-PVA mode LCD. That is, as the voltage difference between the first and second pixel voltages increases, the side visibility of the liquid crystal display may be improved.

Figure 4:
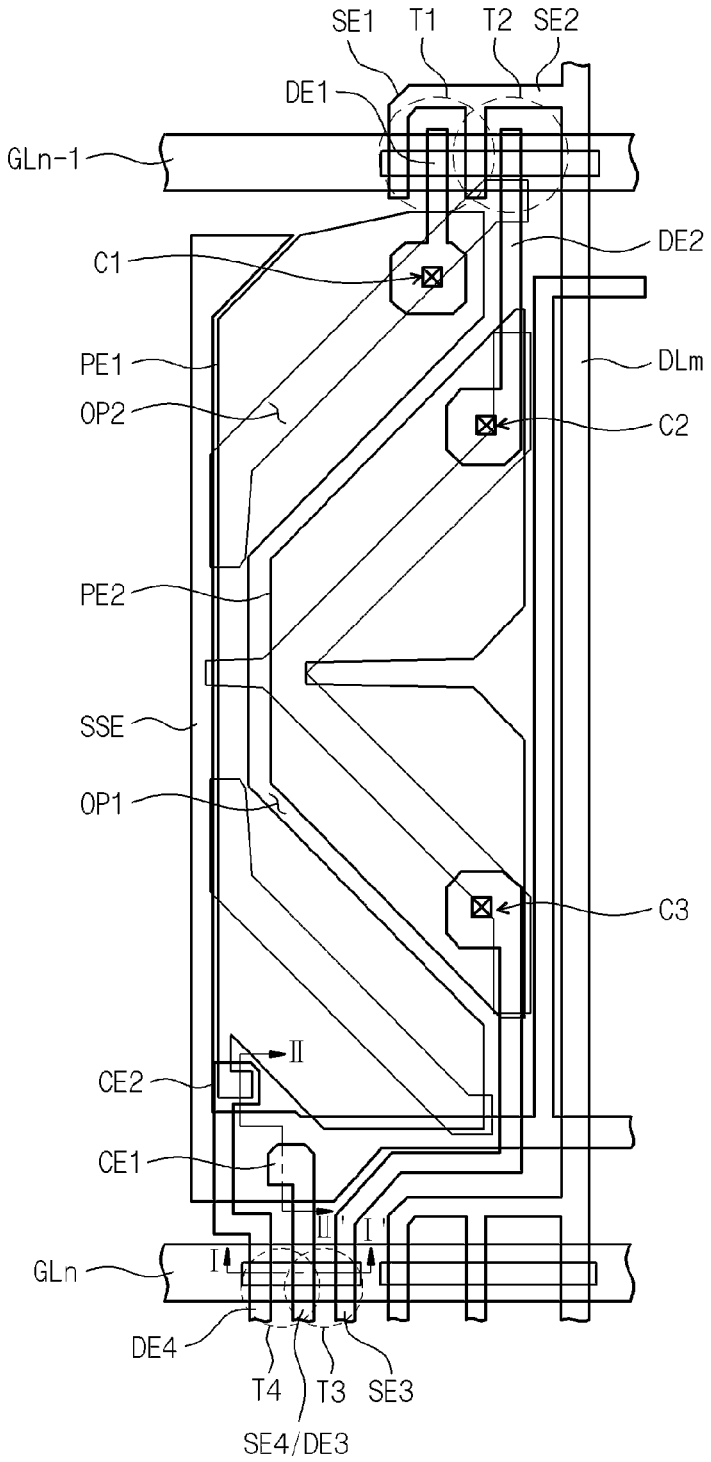
FIG. 4 is a layout diagram showing an $(n-1)^{th}$ pixel part and a voltage controller of FIG. 1.
Figure 5:
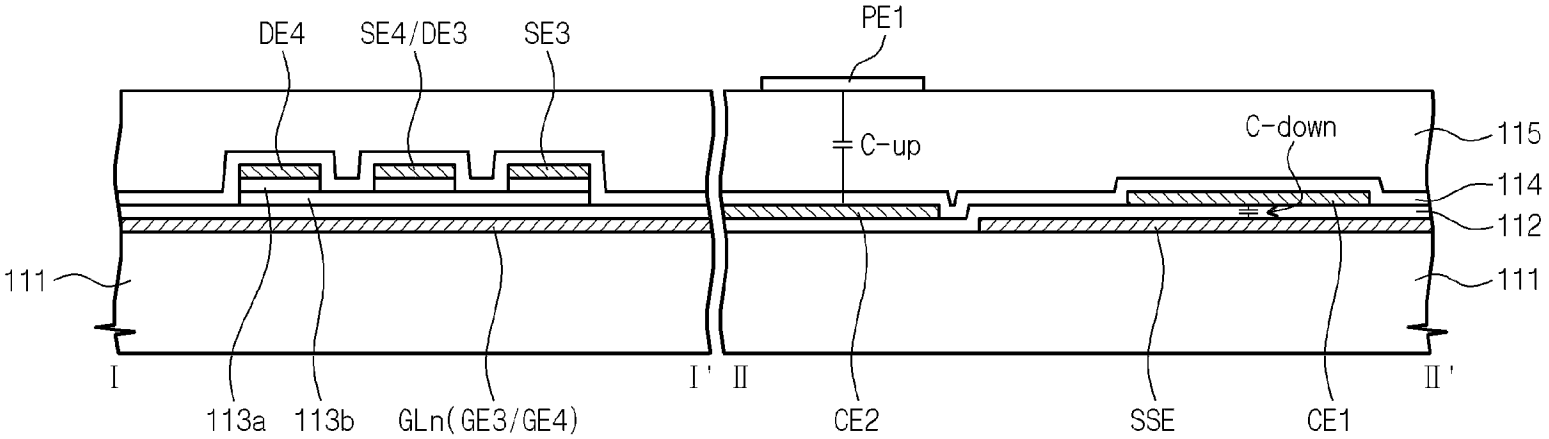
FIG. 5 is a cross-sectional view taken along lines I-I' and II-II' of FIG. 4.

FIG. 4 is a layout diagram showing the $(n-1)^{th}$ pixel part and a voltage controller of FIG. 1, and FIG. 5 is a cross-sectional view taken along lines I-I' and II-II' of FIG. 4.

The display apparatus includes a display panel to display an image and the pixel parts are arranged in a matrix configuration on the display panel. In FIG. 4, a layout diagram of the $(n-1)^{th}$ pixel part is shown.

Referring to FIG. 4 and FIG. 5, the display panel includes two base substrates that are combined with each other (FIG. 5 shows one of the two base substrates), and the $(n-1)^{th}$ gate line GLn-1, the $n^{th}$ gate line GLn, and the storage electrode SSE are formed on one base substrate 111 among the two base substrates by using a gate metal. The common voltage is applied to the storage electrode SSE, and the $(n-1)^{th}$ gate signal and the $n^{th}$ gate signal are applied to the $(n-1)^{th}$ gate line GLn-1 and the $n^{th}$ gate line GLn, respectively.

The $(n-1)^{th}$ gate line GLn-1 includes the gate electrodes of the first thin film transistor T1 and the second thin film transistor T2. The $n^{th}$ gate line GLn includes the gate electrodes of the third thin film transistor T3 and the fourth thin film transistor T4. As shown in FIG. 5, a gate insulating layer 112 covers the $(n-1)^{th}$ gate line GLn-1, the $n^{th}$ gate line GLn, and the storage electrode SSE. The display panel further includes an active layer 113*b* and an ohmic contact layer 113*a* disposed on the gate insulating layer 112, which are arranged in regions corresponding to regions in which the first, second, third, and fourth thin film transistors T1, T2, T3, and T4 are disposed.

The data line DLm, the first source electrode SE1, the second source electrode SE2, the first drain electrode DE1, and the second drain electrode DE2 are disposed on the gate insulating layer 112 and may include metallic material. The second source electrode SE2 is branched from the $m^{th}$ data line DLm, and the first source electrode SE1 is extended from the second source electrode SE2. The first drain electrode DE1 is spaced apart from the first source electrode SE1 above the $(n-1)^{th}$ gate line GLn-1, and the second drain electrode DE2 is spaced apart from the second source electrode SE2 above the $(n-1)^{th}$ gate line GLn-1.

Also, the third source electrode SE3, the third drain electrode DE3, the fourth source electrode SE4, and the fourth drain electrode DE4 are disposed on the gate insulating layer 112. The third source electrode SE3 is spaced apart from the third drain electrode DE3 above the $n^{th}$ gate line GLn, and the fourth drain electrode DE4 is spaced apart from the fourth source electrode SE4 above the $n^{th}$ gate line GLn. In the present exemplary embodiment, the third drain electrode DE3 and the fourth source electrode SE4 are integrally formed with each other.

Thus, the first, second, third, and fourth thin film transistors T1, T2, T3, and T4 may be completed on the base substrate 111.

The first opposite electrode CE1 that forms the down-capacitor C-down is extended from the third drain electrode DE3 and partially overlapped with the storage electrode SSE to be faced with the storage electrode SSE. The second opposite electrode CE2 that forms the up-capacitor C-up is extended from the fourth drain electrode DE4. The second opposite electrode CE2 is partially overlapped with the subsequently formed first pixel electrode PE1.

The display panel further includes a protective layer 114 disposed on the upper portion of the base substrate 111 to cover the first, second, third, and fourth thin film transistors T1, T2, T3, and T4. An organic insulating layer 115 is disposed on the protective layer 114. The first drain electrode DE1, the second drain electrode DE2, and the third source electrode SE3 are exposed through a first contact hole C1, a second contact hole C2, and a third contact hole C3, respectively, that are formed in the protective layer 114 and the organic insulating layer 115.

The first pixel electrode PE1 and the second pixel electrode PE2 may include a transparent conductive material and are disposed on the organic insulating layer 115. Since a first opening OP1 is provided between the first and second pixel electrodes PE1 and PE2, the first and second pixel electrodes PE1 and PE2 are spaced apart from each other, so that the first and second pixel electrodes PE1 and PE2 may be insulated from each other. The first pixel electrode PE1 is connected to the first drain electrode DE1 of the first thin film transistor T1 through the first contact hole C1, and the second pixel electrode PE2 is connected to the second drain electrode DE2 of the second thin film transistor T2 through the second contact hole C2. Also, the second pixel electrode PE2 is connected to the third source electrode SE3 of the third thin film transistor T3 through the third contact hole C3.

The first pixel electrode PE1 is extended and faces the second opposite electrode CE2 to form the up-capacitor C-up, and the first pixel electrode PE1 is partially overlapped with the storage electrode SSE to form the first storage capacitor H-Cst (shown in FIG. 1). The second pixel electrode PE2 is partially overlapped with the storage electrode SSE to form the second storage capacitor L-Cst (shown in FIG. 1).

The common electrode is disposed on a remaining base substrate. The common electrode forms the first liquid crystal capacitor H-Clc with the first pixel electrode PE1, and forms the second liquid crystal capacitor L-Clc with the second pixel electrode PE2.

The common electrode is provided with a second opening OP2 formed therethrough and positioned above the first and second pixel electrodes PE1 and PE2. The second opening OP2 divides regions in which the first and second pixel electrodes PE1 and PE2 are respectively disposed into a plurality of domains. According to the above described structure, the liquid crystals of the liquid crystal layer interposed between the two base substrates are aligned in a different direction in each domain, so that the side visibility of the display apparatus may be improved.

Although not shown in figures, the base substrate on which the common electrode is disposed may further include a black matrix and a color filter layer disposed thereon.

Figure 6:
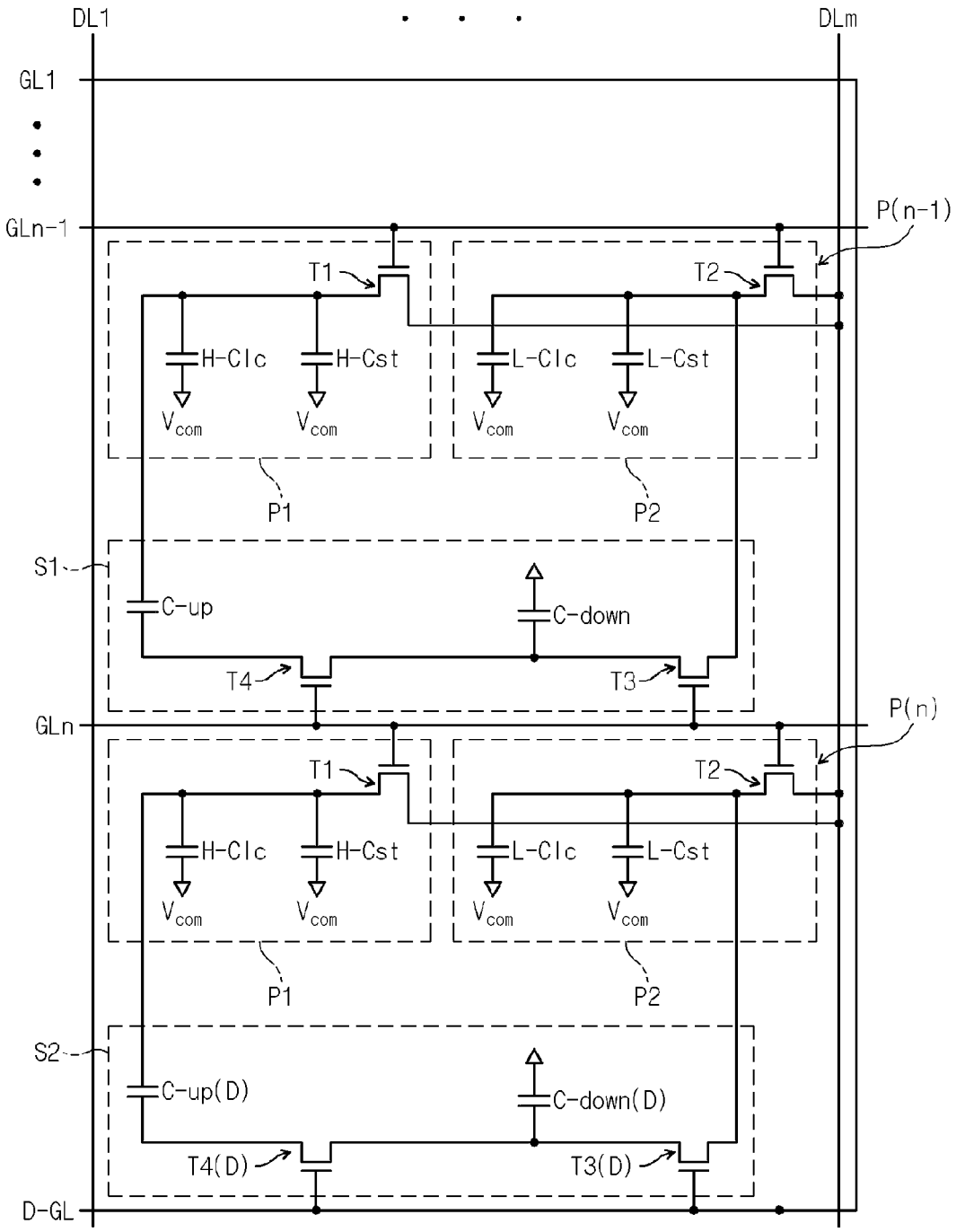
FIG. 6 is an equivalent circuit diagram showing a pixel part, a voltage controller, and a dummy voltage controller in a display apparatus according to another exemplary embodiment of the present invention.

FIG. 6 is an equivalent circuit diagram showing a pixel part, a voltage controller, and a dummy voltage controller in a display apparatus according to another exemplary embodiment of the present invention.

Referring to FIG. 6, a dummy voltage controller S2 is connected to an $n^{th}$ pixel part P(n). The dummy voltage controller S2 includes a dummy gate line D-GL, a dummy level-down part having a first dummy thin film transistor T3(D) and a dummy down-capacitor C-down(D), and a dummy level-up part having a dummy up-capacitor C-up(D) and a second dummy thin film transistor T4(D).

The dummy gate line D-GL is arranged parallel with an $n^{th}$ gate line GLn and spaced apart from the $n^{th}$ gate line GLn, and is connected only to a first gate line GL1. Thus, when a first gate signal is applied to the first gate line GL1 in a next frame, the first gate signal is provided to the dummy gate line D-GL that is connected to the first gate line GL1.

The first dummy thin film transistor T3(D) includes a gate electrode connected to the dummy gate line D-GL, a source electrode connected to a second liquid crystal capacitor L-Clc of the n-th pixel part P(n), and a drain electrode connected to the dummy down-capacitor C-down(D). The second dummy thin film transistor T4(D) includes a gate electrode connected to the dummy gate line D-GL, a source electrode connected to the dummy down-capacitor C-down(D), and a drain electrode connected to the dummy up-capacitor C-up(D).

When the first gate signal is applied to the first gate line GL1 and the dummy gate line D-GL in a next frame after applying an $n^{th}$ gate signal to the $n^{th}$ gate line GLn in order to drive the n-th pixel part P(n) in a present frame, the dummy voltage controller S2 connected to the $n^{th}$ pixel part P(n) starts its operation in response to the first gate signal.

Particularly, the first and second dummy thin film transistors T3(D) and T4(D) are turned on in response to the first gate signal applied to the dummy gate line D-GL. The second liquid crystal capacitor L-Clc shares a charge with the dummy down-capacitor C-down(D) by the turned-on first dummy thin film transistor T3(D). That is, the dummy down-capacitor C-down(D) is charged with a previous pixel voltage in a previous frame. Since the previous pixel voltage has a polarity opposite to the polarities of the first and second pixel voltages, the second pixel voltage charged in the second liquid crystal capacitor L-Clc is lowered by the previous pixel voltage.

The dummy down-capacitor C-down(D) is connected to the dummy up-capacitor C-up(D) by the turned-on second dummy thin film transistor T4(D). Since a voltage charged in the dummy down-capacitor C-down(D) increases due to the charge sharing with the second liquid crystal capacitor L-Clc, the first pixel voltage, which serves as a charge voltage of the first liquid crystal capacitor H-Clc connected to the dummy up-capacitor C-up(D), increases.

As described above, according to another exemplary embodiment of the present invention, the display apparatus further includes the dummy voltage controller S2 to control the first and second pixel voltages charged in pixel parts of the last pixel row where a next gate line does not exist. Thus, the dummy voltage controller S2 may prevent a white brightening phenomenon in which the pixel parts of the last pixel row are brighter than other pixel parts because the first and second pixel voltages charged in the pixel parts of the last pixel row are not controlled.

Also, since the dummy voltage controller S2 lowers the voltage level of the second pixel voltage using the previous pixel voltage that has the polarity opposite to the polarity of the second pixel voltage, the voltage difference between the first and second pixel voltages may increase after controlling the voltage. Therefore, the visibility of the display apparatus may be improved.

Although not shown in FIG. 6, the dummy gate line D-GL of the dummy voltage controller S2 may not be connected to the first gate line GL1. That is, according to another exemplary embodiment of the present invention, a gate driving circuit (not shown) that outputs a gate signal to the first to $n^{th}$ gate lines GL1~GLn may further include a dummy stage that outputs a dummy gate signal to the dummy gate line D-GL. In this case, the dummy gate line D-GL may be connected to the dummy stage to receive the dummy gate signal, thereby controlling the voltage level of the first and second pixel voltages charged in the pixel parts of the last pixel row.

Figure 7:
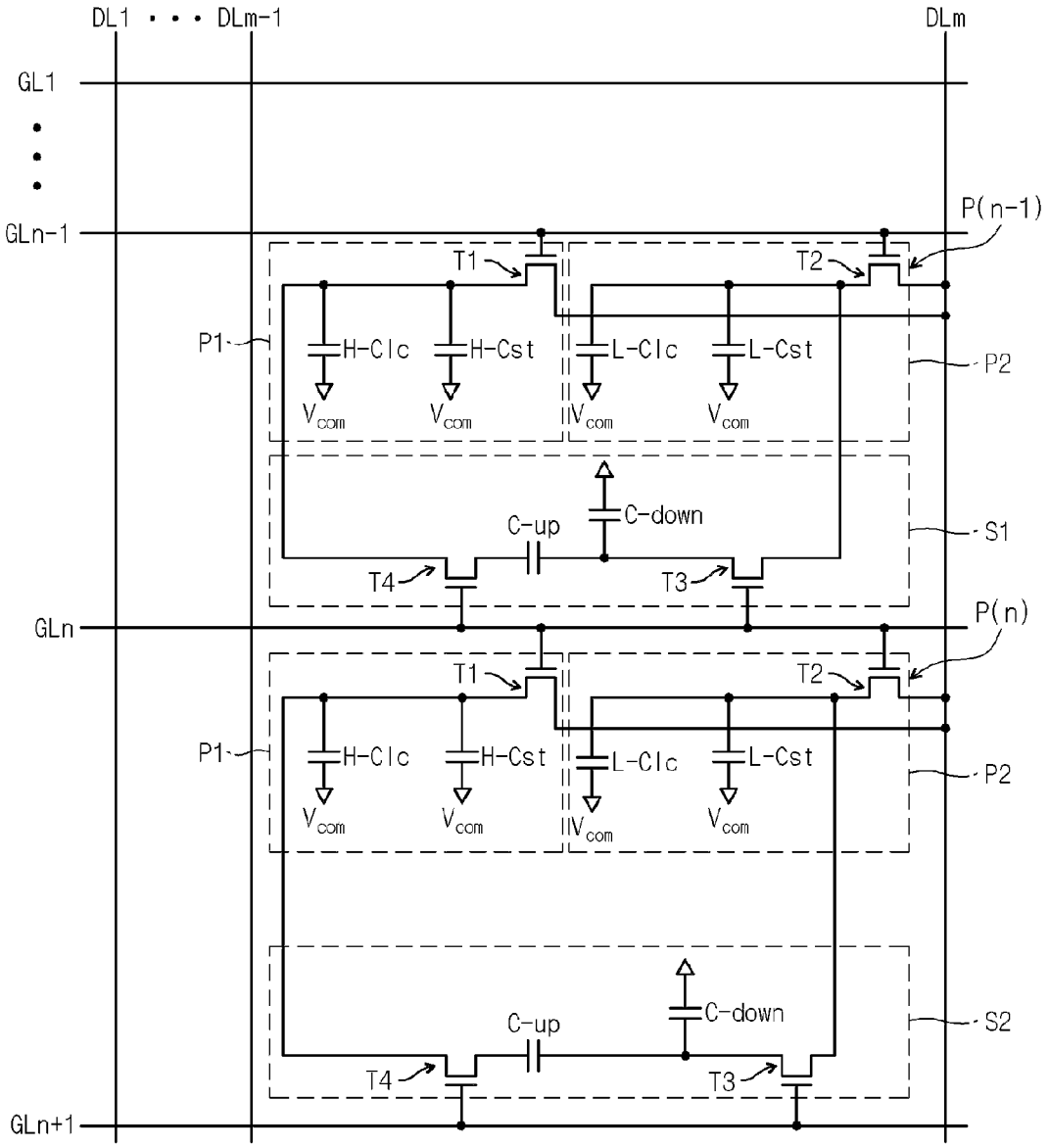
FIG. 7 is an equivalent circuit diagram showing a pixel part in a display apparatus according to another exemplary embodiment of the present invention.

FIG. 7 is an equivalent circuit diagram showing another a pixel part in a display apparatus according to an exemplary embodiment of the present invention.

Referring to FIG. 7, a display apparatus includes first to $n^{th}$ gate lines GL1~GLn and first to $m^{th}$ data lines DL1~DLm. A plurality of pixel areas are defined by the first to $n^{th}$ gate lines GL1~GLn and the first to $m^{th}$ data lines DL1~DLm, and a plurality of pixel parts are arranged in the pixel areas in one-to-one fashion.

In FIG. 7, equivalent circuit diagrams of an $(n-1)^{th}$ pixel part P(n−1) and $n^{th}$ pixel part P(n) connected to an $(n-1)^{th}$ gate line GLn-1 and the $m^{th}$ data line DLm have been shown. In the present exemplary embodiment, the pixel parts have a same circuit configuration and a same circuit function as those of the pixel parts in FIG. 1, and thus the detailed descriptions of the pixel parts will be omitted.

The display apparatus includes a plurality of voltage controllers that are connected to the pixel parts in one-to-one fashion to control a voltage level of the first and second pixel voltages that are respectively charged in a corresponding pixel part. In FIG. 7, a $(n-1)^{th}$ voltage controller S1 that is connected to the $(n-1)^{th}$ pixel part P(n−1) to control a voltage level of the first and second pixel voltages that are respectively charged in the first and second pixels P1 and P2 of the $(n-1)^{th}$ pixel part P(n−1). In the present exemplary embodiment, the voltage controllers have a same circuit configuration and a same function, and thus, only the $(n-1)^{th}$ voltage controller S1 will be described in detail in order to avoid redundancy.

The $(n-1)^{th}$ voltage controller S1 includes a level-down part having a third thin film transistor T3 and a down-capacitor C-down and a level-up part having a fourth thin film transistor T4 and an up-capacitor C-up.

The third thin film transistor T3 includes a third gate electrode connected to the $n^{th}$ gate line GLn, a third source electrode connected to the second pixel electrode for the second liquid crystal capacitor L-Clc, and a third drain electrode connected to the down-capacitor C-down. The down-capacitor C-down is connected between the third drain electrode and the electrode to which the common voltage Vcom is applied.

The fourth thin film transistor T4 includes a fourth gate electrode connected to the $n^{th}$ gate line GLn, a fourth source electrode connected to the first pixel electrode for the first liquid crystal capacitor H-Clc, and a fourth drain electrode connected to the up-capacitor C-up. The up-capacitor C-up is connected between the third and fourth drain electrodes.

Figure 8A:
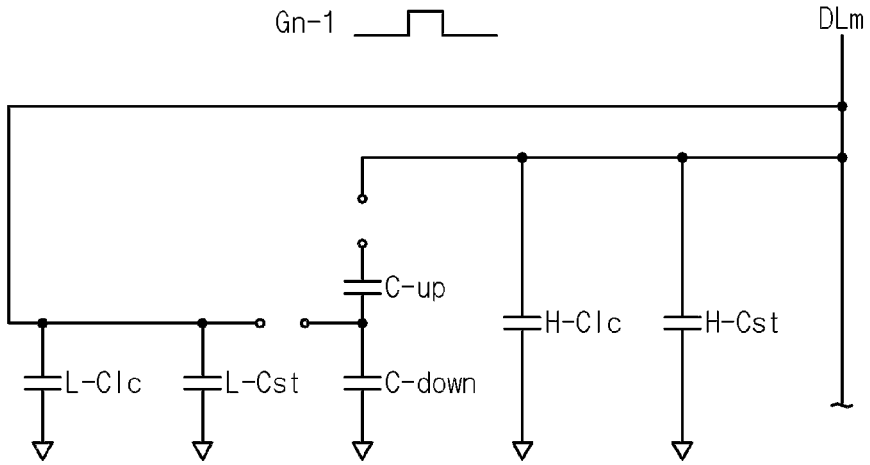
FIG. 8A is an equivalent circuit diagram showing an $(n-1)^{th}$ pixel when an $(n-1)^{th}$ gate signal is applied to an $(n-1)^{th}$ gate line of FIG. 7.
Figure 8B:
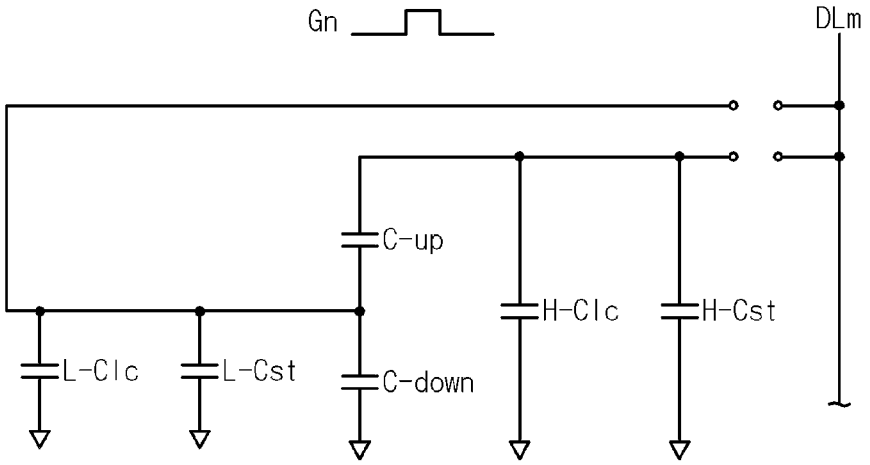
FIG. 8B is an equivalent circuit diagram showing an $(n-1)^{th}$ pixel when an $n^{th}$ gate signal is applied to an $n^{th}$ gate line of FIG. 7.

FIG. 8A is an equivalent circuit diagram showing an $(n-1)^{th}$ pixel when an $(n-1)^{th}$ gate signal is applied to an $(n-1)^{th}$ gate line of FIG. 7, and FIG. 8B is an equivalent circuit diagram showing an $(n-1)^{th}$ pixel when an $n^{th}$ gate signal is applied to an $n^{th}$ gate line of FIG. 7.

As shown in FIG. 7 and FIG. 8A, when the $(n-1)^{th}$ gate signal is applied to the $(n-1)^{th}$ gate line GLn-1, the first and second thin film transistors T1 and T2 respectively arranged in the first and second pixels P1 and P2 are turned on. Thus, the data signal applied to the $m^{th}$ data line DLm is provided to the first and second pixel electrodes of the first and second liquid crystal capacitors H-Clc and L-Clc through the first and second thin film transistors T1 and T2, respectively. Since the first and second pixel electrodes of the first and second liquid crystal capacitors H-Clc and L-Clc are commonly connected to the $m^{th}$ data line DLm, the first and second pixel electrodes receive the data signal substantially simultaneously. Accordingly, a first pixel voltage and a second pixel voltage having the same voltage level are charged in the first and second liquid crystal capacitors H-Clc and L-Clc, respectively, during an $(n-1)^{th}$ horizontal scanning period.

As shown in FIG. 7 and FIG. 8B, when the third and fourth thin film transistors T3 and T4 are turned on in response to the $n^{th}$ gate signal Gn applied to the $n^{th}$ gate line GLn, the second liquid crystal capacitor L-Clc is connected to the down-capacitor C-down through the third thin film transistor T3, and the first liquid crystal capacitor H-Clc is connected to the up-capacitor C-up through the fourth thin film transistor T4.

Consequently, the second liquid crystal capacitor L-Clc shares a charge with the down-capacitor C-down in response to the $n^{th}$ gate signal Gn. The down-capacitor C-down is charged by a previous pixel voltage in response to a data signal applied in a previous frame. Since the data signal has a polarity inverted at every frame, the previous pixel voltage has a polarity opposite to polarities of the first and second pixel voltages. Thus, the second pixel voltage charged in the second liquid crystal capacitor L-Clc is lowered by the previous pixel voltage charged in the down-capacitor C-down.

The voltage charged in the down-capacitor C-down is boosted up during the charge-sharing operation, and the first pixel voltage of the first liquid crystal capacitor H-Clc is also boosted up. Consequently, the voltage levels of the first pixel voltage charged in the first liquid crystal capacitor H-Clc and the second pixel voltage charged in the second liquid crystal capacitor L-Clc are controlled by the up-capacitor C-up and the down-capacitor C-down. That is, the voltage level of first pixel voltage is boosted up by the up-capacitor C-up and the down-capacitor C-down, and the voltage level of second pixel voltage is lowered by the up-capacitor C-up and the down-capacitor C-down.

As described above, the first pixel voltage and the second pixel voltage having the same voltage level are charged in the first pixel P1 and the second pixel P2 of the $(n-1)^{th}$ pixel part P(n−1) in response to the $(n-1)^{th}$ gate signal, and then, the first pixel voltage and the second pixel voltage are controlled to have the different voltage levels from each other by the $n^{th}$ gate signal Gn. Thus, the first and second pixels P1 and P2 of the $(n-1)^{th}$ pixel part P(n−1) may display two images having different gray-scale levels from each other. Further, the user recognizes an image in which the two images are mixed with each other, so that the visibility of the display apparatus may be improved.

Figure 9:
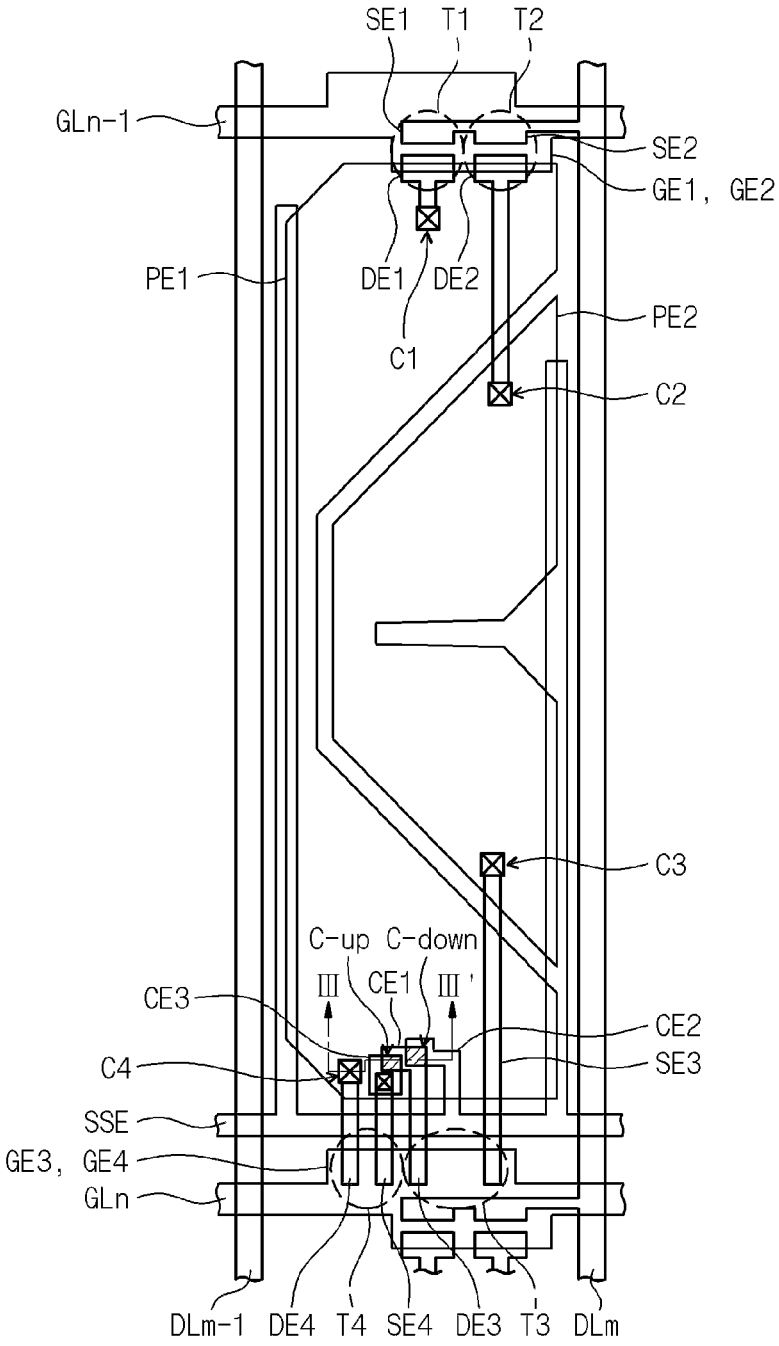
FIG. 9 is a layout diagram showing an $(n-1)^{th}$ pixel part and a voltage controller of FIG. 7.
Figure 10:
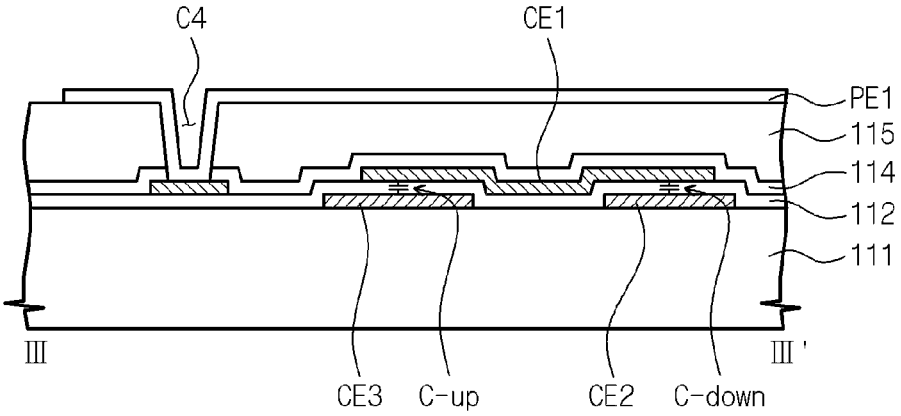
FIG. 10 is a cross-sectional view taken along line III-III' of FIG. 9.

FIG. 9 is a layout diagram showing an $(n-1)^{th}$ pixel part and a voltage controller of FIG. 7, and FIG. 10 is a cross-sectional view taken along line III-III' of FIG. 9.

Referring to FIG. 9 and FIG. 10, the $(n-1)^{th}$ gate line GLn-1, the $n^{th}$ gate line GLn, and the storage electrode SSE are disposed on a base substrate 111 and may include metallic material. The first gate electrode GE1 of the first thin film transistor T1 and the second gate electrode GE2 of the second thin film transistor T2 are branched from the $(n-1)^{th}$ gate line GLn-1 and integrally formed with each other. The third gate electrode GE3 of the third thin film transistor T3 and the fourth gate electrode GE4 of the fourth thin film transistor T4 are branched from the $n^{th}$ gate line GLn and integrally formed with each other.

As shown in FIG. 10, the gate insulating layer 112 covers the (n−1)th gate line GLn-1, the $n^{th}$ gate line GLn, and the storage electrode SSE. Although not shown in FIG. 9 and FIG. 10, an active layer and an ohmic contact layer are disposed on the gate insulating layer 112, which are arranged in regions corresponding to regions in which the first, second, third, and fourth thin film transistors T1, T2, T3, and T4 are disposed.

The data line DLm, the first source electrode SE1, the second source electrode SE2, the first drain electrode DE1, and the second drain electrode DE2 are disposed on the gate insulating layer 112 and may include metallic material. The second source electrode SE2 is branched from the $m^{th}$ data line DLm, and the first source electrode SE1 is extended from the second source electrode SE2. The first drain electrode DE1 is spaced apart from the first source electrode SE1 above the first gate electrode GE1, and the second drain electrode DE2 is spaced apart from the second source electrode SE2 above the second gate electrode GE2.

Also, the third source electrode SE3, the third drain electrode DE3, the fourth source electrode SE4, and the fourth drain electrode DE4 are disposed on the gate insulating layer 112. The third source electrode SE3 is spaced apart from the third drain electrode DE3 above the third gate electrode GE3, and the fourth drain electrode DE4 is spaced apart from the fourth source electrode SE4 above the fourth gate electrode GE4. Accordingly, the first, second, third, and fourth thin film transistors T1, T2, T3, and T4 may be disposed on the base substrate 111.

The first opposite electrode CE1 of the down-capacitor C-down extends from the third drain electrode DE3, and the second opposite electrode CE2 of the down-capacitor C-down extends from the storage electrode SSE to face the first opposite electrode CE1. The first opposite electrode CE1 of the up-capacitor C-up is integrally formed with the first opposite electrode CE1 of the down-capacitor C-down, and the third opposite electrode CE3 of the up-capacitor C-up faces the first opposite electrode CE1 of the up-capacitor C-up. Further, the third opposite electrode CE3 of the up-capacitor C-up is connected to the source electrode SE4 of the fourth thin film transistor T4.

A protective layer 114 is further disposed on the upper portion of the base substrate 111 to cover the first, second, third, and fourth thin film transistors T1, T2, T3, and T4. An organic insulating layer 115 is disposed on the protective layer 114. The first drain electrode DE1, the second drain electrode DE2, the third source electrode SE3, and the fourth drain electrode DE4 are exposed through a first contact hole C1, a second contact hole C2, a third contact hole C3, and a fourth contact hole C4, respectively, that are formed in the protective layer 114 and the organic insulating layer 115.

The first pixel electrode PE1 and the second pixel electrode PE2 may include a transparent conductive material and are disposed on the organic insulating layer 115. The first and second pixel electrodes PE1 and PE2 are spaced apart from each other and insulated from each other. The first pixel electrode PE1 is connected to the first drain electrode DE1 of the first thin film transistor T1 through the first contact hole C1, and the second pixel electrode PE2 is connected to the second drain electrode DE2 of the second thin film transistor T2 through the second contact hole C2. Also, the second pixel electrode PE2 is connected to the third source electrode SE3 of the third thin film transistor T3 through the third contact hole C3, and the first pixel electrode PE1 is connected to the fourth drain electrode DE4 of the fourth thin film transistor T4 through the fourth contact hole C4.

The circuit configurations and the functions of the voltage controller that have been shown in FIG. 9 and FIG. 10 may be embodied in many different ways and should not be construed as limited to the exemplary embodiments set forth herein According to the above, since the display apparatus lowers the voltage level of the second pixel voltage charged in the second pixel using the previous pixel voltage that is charged in the previous frame in response to the next gate signal, the voltage difference between the first and second pixel voltages may increase, thereby improving the side visibility of the display apparatus.

Also, the display apparatus may receive the lowered second pixel voltage to boost up the voltage level of the first pixel voltage charged in the first pixel in response to the next gate signal, so that deterioration of the transmittance of the display apparatus may be prevented.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. A display apparatus, comprising:

a first substrate;

a first gate line disposed on the first substrate;

a second gate line extending substantially parallel to the first gate line;

a storage pattern disposed on the same layer as the first gate line and the second gate line;

a data line crossing the first gate line and the second gate line;

a first sub pixel electrode and a second sub pixel electrode disposed on the first substrate;

a first thin film transistor comprising a first terminal connected to the first gate line, a second terminal connected to the data line, and a third terminal connected to the first sub pixel electrode;

a second thin film transistor comprising a first terminal connected to the first gate line, a second terminal connected to the data line, and a third terminal connected to the second sub pixel electrode;

a third thin film transistor comprising a first terminal connected to the second gate line, a second terminal connected to the second sub pixel electrode, and a third terminal connected to a first opposite electrode, the first opposite electrode overlapping with the storage pattern; and a fourth thin film transistor comprising a first terminal connected to the second gate line, a second terminal connected to the third terminal of the third thin film transistor, and a third terminal connected to a second opposite electrode overlapping with the first sub pixel electrode, wherein a width of the storage pattern is larger than a width of the first opposite electrode when measured along a line extending in a direction of the data line.

2. The display apparatus of claim 1, wherein the third terminal of the third thin film transistor and the second terminal of the fourth thin film transistor are integrally formed with each other.

3. The display apparatus of claim 1, wherein the first opposite electrode is extended from the third terminal of the third thin film transistor and partially overlapped with the storage pattern to be faced with the storage pattern.

4. The display apparatus of claim 1, wherein the second opposite electrode is extended from the third terminal of the fourth thin film transistor and partially overlapped with the first sub pixel electrode.

5. The display apparatus of claim 1, wherein the first sub pixel electrode is partially overlapped with the storage pattern.

6. The display apparatus of claim 1, wherein the second sub pixel electrode is partially overlapped with the storage pattern.

7. The display apparatus of claim 1, further comprising:

a second substrate facing the first substrate; and a common electrode disposed on the second substrate and facing the first sub pixel electrode and the second sub pixel electrode.

8. The display apparatus of claim 7, wherein the first sub pixel electrode and the second sub pixel electrode are spaced apart from each other and insulated from each other.

9. The display apparatus of claim 8, wherein the common electrode comprises an opening formed therethrough, and the opening is positioned in a region different from a region between the first sub pixel electrode and the second sub pixel electrode.

* * * * *